United States Patent [19]

Weber

[11] 3,952,931

[45] Apr. 27, 1976

[54] INSULATED TERMINAL SEPARATION

[75] Inventor: Donald R. Weber, Walpole, Mass.

[73] Assignee: Ark-Les Switch Corporation, Watertown, Mass.

[22] Filed: Dec. 6, 1974

[21] Appl. No.: 530,199

[52] U.S. Cl. ..... 225/103; 225/93

[51] Int. Cl.[2] ..... B26F 3/00

[58] Field of Search ..... 225/94, 96, 96.5, 97, 225/103, 104, 2; 29/203 R, 203 DT, 203 DS, 628

[56] References Cited

UNITED STATES PATENTS

| | | | |
|---|---|---|---|
| 2,659,950 | 11/1953 | West | 225/93 X |
| 3,149,765 | 9/1964 | Horning et al. | 225/103 X |
| 3,192,610 | 7/1965 | Keating | 225/103 X |
| 3,668,764 | 6/1972 | Randar | 29/203 DS |
| 3,854,512 | 12/1974 | Hill | 225/96.5 X |

FOREIGN PATENTS OR APPLICATIONS

| | | | |
|---|---|---|---|
| 849,941 | 9/1960 | United Kingdom | 29/203 R |

*Primary Examiner*—J. M. Meister
*Assistant Examiner*—Fred A. Silverberg

[57] ABSTRACT

Apparatus for separating an assembled insulated wire terminal from a carrier strip segment. The assembled terminal has an insulating plastic sleeve surrounding the metal body, the forward end of the body being attached to the carrier strip segment at a prescored separation line extending generally parallel to the length of the carrier strip and within the sleeve. The apparatus comprises positioning means to retain the assembled wire terminal in a fixed position, and flexing means to flex the carrier strip segment at the prescored separation line successively in two senses with respect to the wire terminal retained in the fixed position, to separate the carrier strip segment from the terminal at the prescored separation line within the sleeve.

2 Claims, 12 Drawing Figures

FIG 5
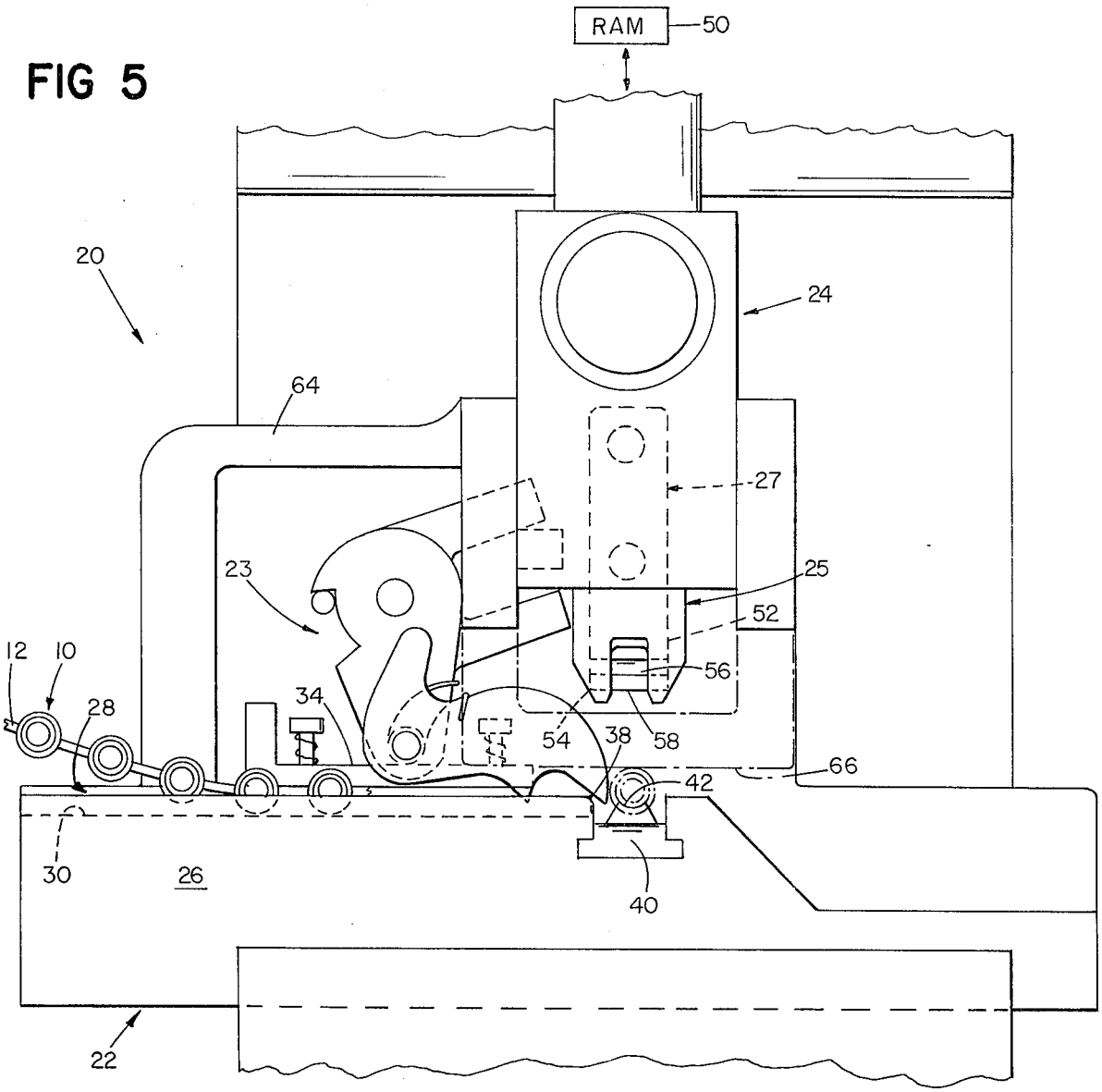
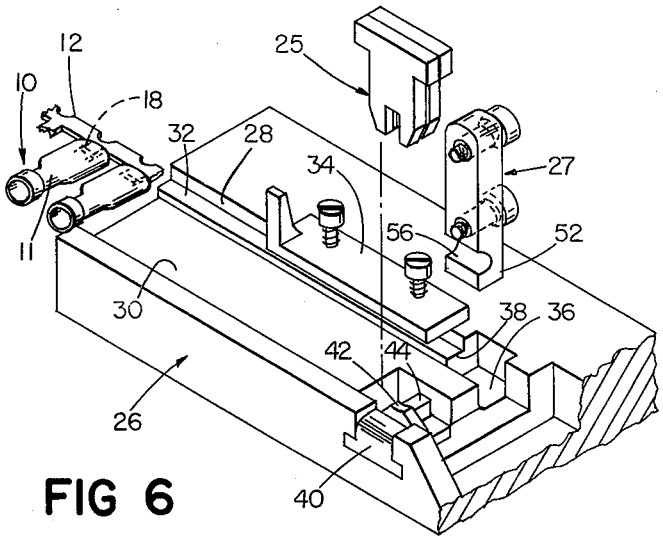
FIG 6
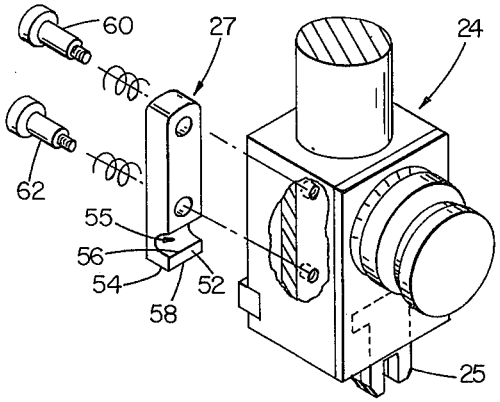
FIG 7

INSULATED TERMINAL SEPARATION

This invention relates to the separation of terminals from a carrier strip. More precisely, it relates to the separation of assembled insulated wire terminals from a carrier strip to which they are endwise attached, the separation line being within the insulating sleeve of the terminal.

It is conventional to assemble terminals to wires by supplying the terminals, attached to a carrier strip, together with lengths of cut and stripped wire, to an apparatus to crimp the terminal wire-receiving elements over the wire. Each assembled unit is then detached individually at a point between the terminal and the carrier strip, either in the same operation or at a later time. The separation is conventionally accomplished by shearing the metal between upper and lower cutting edges.

However, terminals of the type concerned in the present application are supplied for assembly conventionally attached to a carrier strip, but having preformed insulating sleeves already in place over the terminals. The point of separation between the terminal and the carrier strip is within the insulating sleeve. This design is advantageous because it insures that the metal portions of the terminal are entirely within the insulating portions when it is in use. However, because of the position of the separation line within the insulator, conventional separation apparatus employing upper and lower cutting edges to shear the metal is not suitable for separation of these terminals from the carrier strip.

It is therefore an object of this invention to provide apparatus for assembling insulated terminals to wires and separating the assembled insulated wire terminals from the carrier strip at a separation line within the insulator.

The invention provides apparatus for separating an assembled insulated wire terminal from a carrier strip segment, the assembled terminal including a metal body having at its rear end wire receiving elements and at its forward end terminal receiving elements, and having an insulating plastic sleeve surrounding the metal body. The forward end is attached to the carrier strip segment at a prescored separation line, extending generally parallel to the length of the carrier strip and positioned within the sleeve. The apparatus comprises positioning means to retain the assembled wire terminal in a fixed position, and flexing means to flex the carrier strip segment at the prescored separation line successively in two senses with respect to the wire terminal retained in the fixed position, to separate the carrier strip segment from the terminal at the prescored separation line within the sleeve.

In preferred embodiments the separation line is prescored on both surfaces of the metal, and the positioning means comprises a base defining a feed path for the carrier strip with attached terminals, and retaining means fixed with respect to the base adjacent the base feed path and cooperating therewith to retain an insulated terminal in a fixed position. The flexing means comprises a separating tool having a segment-flexing end adjacent the base, providing first and second segment-flexing surfaces extending generally parallel to the feed path and spaced apart; reciprocating means for reciprocating the separating tool past the base feed path; pivot means connecting the separating tool and the reciprocating means at a pivot point spaced from the segment-flexing end for pivotal motion of the segment-flexing end away from the reciprocating means and generally transverse to the feed path; and biasing means for returning the separating tool toward the reciprocating means.

As the reciprocating means moves the separating tool past the base feed path, the separating tool first segment- flexing surface engages the carrier strip segment to flex the segment in a first sense from the prescored line and to cam the segment-flexing end into pivotal motion away from the reciprocating means and past the segment. The biasing means tends to return the separating tool toward the reciprocating means. As the reciprocating means reverses to move the separating tool away from the base, the second segment-flexing surface engages the segment to flex the segment in a second sense from the prescored line to separate the terminal from the segment.

The base feed path provides a base cutting edge extending generally transverse to and beneath the feed path, and the separating tool segment-flexing end further provides a cutting edge adjacent the base cutting edge and parallel thereto. As the reciprocating means carries the separating tool past the base feed path, the tool cutting edge is carried past the base cutting edge to sever a leading strip segment with attached terminal from the carrier strip.

Other objects, features and advantages will appear from the following description of a preferred embodiment of the invention, taken together with the attached drawings thereof; in which:

FIG. 5 is a front elevation of the apparatus of the invention;

FIG. 6 is a view of the base portion of the apparatus, partly broken away;

FIG. 7 is an exploded view of the reciprocable portion of the apparatus;

Figure 4:
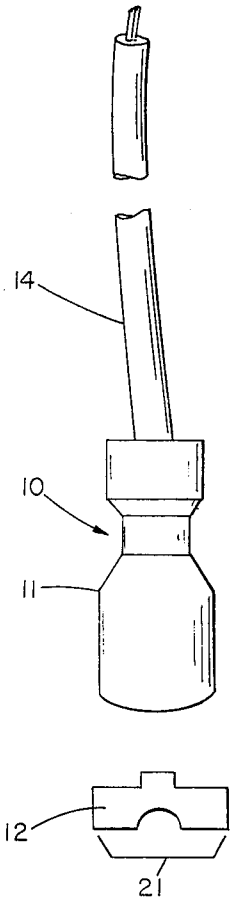
FIGS. 1 through 4 are views of the insulated terminal and its carrier strip.
Figure 3:
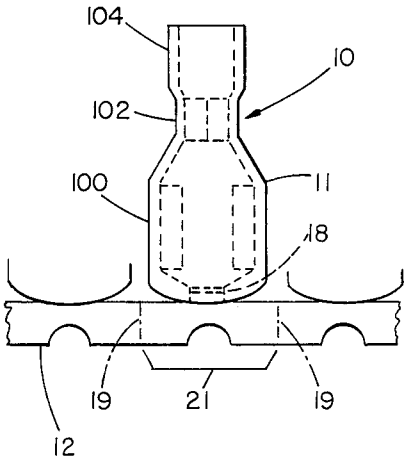
Figure 2:
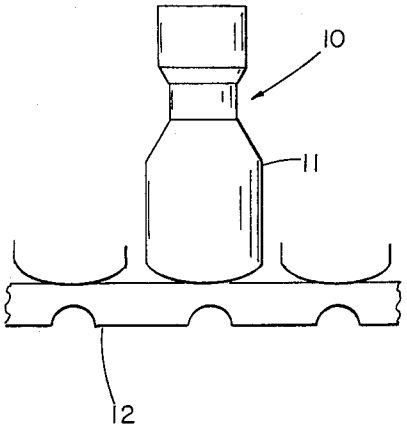
Figure 1:
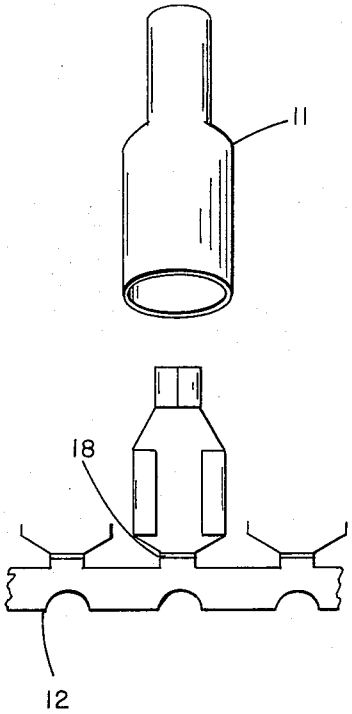

The apparatus of the invention separates insulated wire terminals from a carrier strip. Insulated terminals of the type in question are assembled by apparatus disclosed in U.S. Pat. No. 3,831,254, issued Aug. 27, 1974 and assigned to the same assignee as the present application. The apparatus shown in U.S. Pat. No. 3,831,254 forms and assembles preformed plastic insulating sleeves 11 (referring particularly to FIGS. 1 through 4 of the present application) to female terminals 13 attached endwise to a carrier strip 12 and formed integrally therewith, to produce an assembled insulated terminal 10. Each terminal 13 has a metal body having at its rear end wire receiving elements 70 and at its forward end terminal receiving elements 72, the forward end being attached to the carrier strip 12. Insulating sleeve 11 of the assembled insulated terminal 10 includes a somewhat flattened body portion surrounding the terminal receiving elements 72, a narrower neck portion 102 surrounding the wire receiving elements 70, and an end portion 104 somewhat larger than neck 102.

In the production of the assembled terminal by the apparatus of U.S. Pat. No. 3,831,254, a line 18 is prescored on both surfaces of the metal at the point of attachment of the forward end of each terminal 13 to carrier strip 12; line 18 extends generally parallel to the length of carrier strip 12. After insulating sleeve 11 has been assembled to the terminal, body portion 100 of insulating sleeve 11 covers the prescored line, as seen particularly in FIG. 3 of the present application.

In a subsequent operation, performed by apparatus not shown in U.S. Pat. No. 3,831,254 lengths of insulated wire 14 are inserted through sleeve ends 104 into the assembled terminals, which are then crimped through portions 70, 102 and 104 to retain the wire, in a manner well known in the art. The assembled wire and terminal units (FIG. 4) must then be detached from the carrier strip for use. This is accomplished by severing the carrier strip 12 successively along lines 19 (FIG. 3), thus dividing strip 12 into segments 21, and by separating each assembled insulated wire terminal from its segment 21. The separation occurs at the prescored line 18 within insulator 11. This design is advantageous because it insures that the metal portions of the terminal are entirely within the insulating portions when it is in use. However, because of the position of the separation line within the insulator, conventional separation apparatus is not suitable for separation of these terminals from the carrier strip and novel apparatus must be provided for this purpose.

According to the invention, and referring now particularly to FIGS. 5 through 8, apparatus 20 is provided to crimp an assembled terminal 10 over the end of an inserted wire 14, and in the same operation to detach the assembled terminal with its attached wire from the carrier strip at prescored line 18.

Apparatus 20 generally comprises a fixed base 22 and a plunger assembly 24 that is reciprocable with respect to base 22 within a fixed upper housing 64. A carrier strip 12 of assembled insulated terminals 10 is fed between base 22 and reciprocable plunger assembly 24 by feed finger means 23, while lengths of insulated wire are fed (by means not shown here) at right angles to the direction of travel of strip 12. Reciprocable assembly 24 carries crimping tools 25 and a separating tool 27 toward and away from strip 12 to assemble crimped terminal and wire units and to separate the assembled units from the carrier strip in one operation.

Referring now particularly to FIG. 6, base 22 is a generally rectangular block providing a depressed track 30 extending in the direction of feed of the carrier strip, and further providing an adjacent narrow rear marginal portion 32 raised slightly above the level of track 30 and extending parallel with it. A front wall 26 extends generally above the level of track 30, and rear surface 28, adjacent marginal portion 32, extends above the level of marginal portion 32. Front wall 26, track 30, rear marginal portion 32, and rear surface 28 together define a feed path for carrier strip 12 with attached insulated terminals 10. Carrier strip 12 is supported on marginal portion 32, while the terminals are supported on track 30. The entire strip is confined between front wall 26 and rear surface 28. The strip of terminals is advanced along the feed path by feed finger means 23 (FIG. 5) in synchronism with the reciprocation of assembly 24.

A recess 36 is provided in base 22, extending below the feed path, and intersecting with marginal portion 32 to form a base cutting edge 38, which extends generally across the feed path. Recess 36 accommodates the separating tool 27 on its downward stroke. A spring-loaded strip retainer 34 confines strip 12 against marginal portion 32 in the feed path region immediately preceding recess 36.

Base 22 further provides an insert 40 in front wall 26, in line with recess 36 across the feed path, and including anvil portions 42 and 44. As the strip of insulated terminals is advanced along the feed path, each terminal reaches a lead position in which insulating sleeve neck portion 102 lies over anvil portion 44 and sleeve end portion 104 lies over anvil portion 42, while the carrier strip 12 lies over recess 36.

Fixed housing 64 provides retaining means in the form of a U-shaped keeper 66 (seen particularly in FIGS. 5 and 8) which bears on body portion 100 of each insulator 11 as the terminal 10 reaches the leading position. Keeper 66 cooperates with the feed path elements to maintain the leading terminal in a fixed horizontal position.

Plunger 24 is reciprocated within fixed housing 64 with respect to base 22 in a manner well known in the art, by a ram indicated at 50 (FIG. 5). Plunger 24 carries two crimping tools 25 adapted to crimp portions 102 and 104 of terminal insulator 11 against anvil portions 44 and 42 respectively on the downstroke of the ram. The crimping action retains the inserted wire within the metal terminal in a conventional manner that will not be further described.

Plunger 24 further carries a novel separating tool 27 having a segment-flexing end 52 adjacent base 22. End 52 of tool 27 provides a cutting edge 54 parallel with the base cutting edge 38 of base 22 and cooperating therewith on the downstroke of plunger 24 to cut through carrier strip 12 along a line 19 transverse to the direction of travel of strip 12. In addition, separating tool 27 is formed with a cut-out 55 to provide an upper segment-flexing surface 56. The lower surface of end 52 acts as a lower segment-flexing surface 58. Surfaces 56 and 58 extend generally parallel with the feed path and are spaced apart vertically, as seen particularly in FIGS. 5 and 8.

Separating tool 27 is secured to plunger 24 by means of two spring-loading screws 60 and 62 remote from the feed path, which pass through clearance holes in tool 27 and enter threaded holes in plunger 24. Tool 27 is thus biased into a position parallel with plunger 24, or perpendicular with respect to base 22, but is movable against the bias, outwardly from plunger 24, at screw 60. The outward motion of tool 27 is generally transverse to the feed path.

Referring now particularly to FIGS. 9 through 12, in operation, a carrier strip 12 of insulated terminals 10 is fed along the feed path by feed finger means 23 as previously described. As each terminal reaches the leading position, in which it is aligned across the feed path with portions 104 and 102 of the insulator 11 supported on anvil portions 42 and 44, and with carrier strip 12 lying above recess 36, a length of wire 14 is inserted into end 104 of terminal 10 and plunger 24 is moved downwardly toward base 22 by ram 50.

Figure 9:
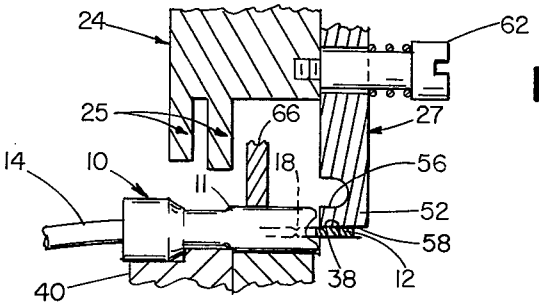
FIGS. 9, 10, 11 and 12 are views of the operative portions of the apparatus during successive stages of separating a terminal from its carrier strip.
Figure 10:
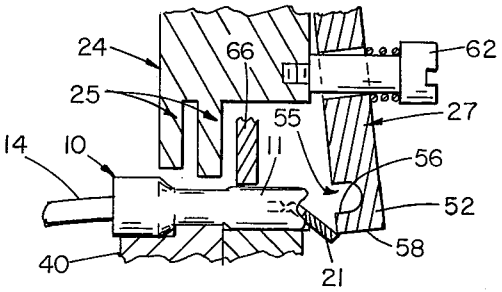
Figure 11:
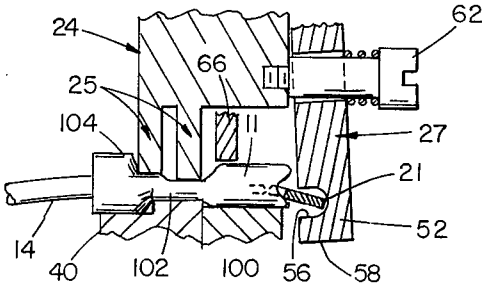
Figure 12:
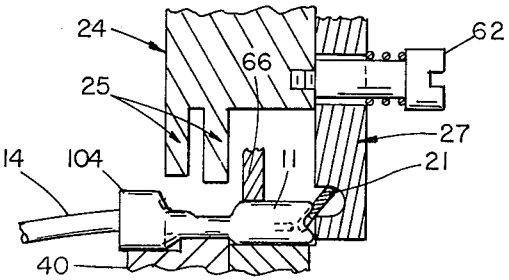
Figure 8:
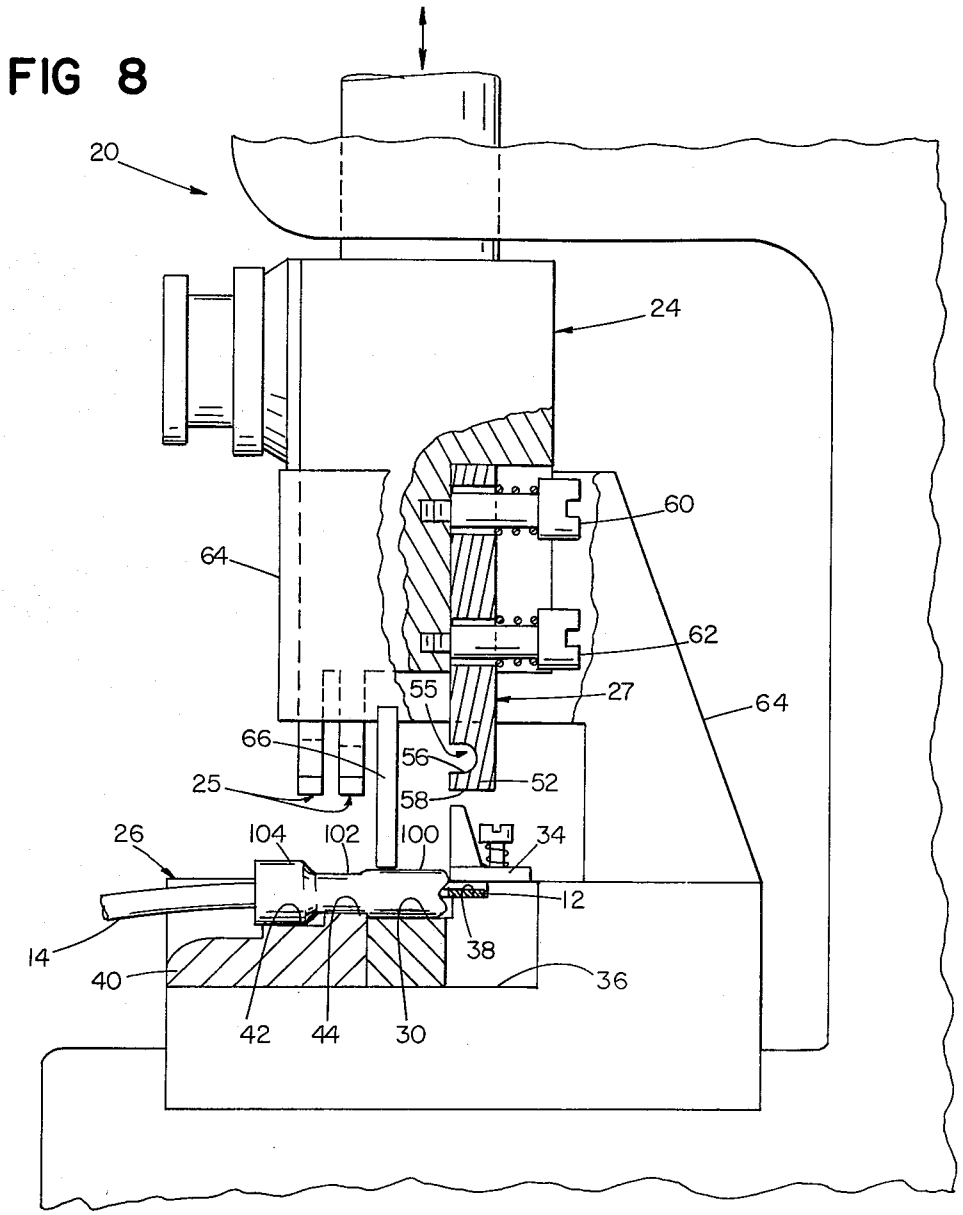
FIG. 8 is a side view of the apparatus of the invention, partly in section, with a strip of terminals in position therein.

As tool 27 is carried downwardly by plunger 24, lower segment-flexing surface 58 engages the upper surface of carrier strip 12 (FIG. 9). Cutting edge 54 of separating tool 27 cooperates with base cutting edge 38 to sever carrier strip 12 along a line 19 (FIG. 3) as tool 27 moves downwardly, creating a segment 21 of carrier strip to which the terminal in the leading position is attached. Strip retainer 34 retains the remote portion of carrier strip 12 against marginal portion 32 as segment 21 is severed. Keeper 66 cooperates with the feed path elements to retain terminal 10 in a fixed horizontal position and to prevent it from moving upwardly, as surface 58 of tool 27 flexes segment 21 in a first sense, namely downwardly, at prescored line 18. Separating tool 27 is cammed outwardly from plunger 24 (FIG. 10) as its segment-flexing end 52 slides past the bent segment 21.

Further downward travel of plunger 24 (FIG. 11) brings crimping tools 25 into engagement with portions 102 and 104 of insulator 11 to crimp the terminal over wire 14. At the same time, tool 27 is carried downwardly past segment 21 of the carrier strip, which moves into cut-out 55 of segment- flexing end 52. Tool 27 is biased toward plunger 24. On the upward stroke of the plunger 24 (FIG. 12), upper segment-flexing surface 56 engages the lower surface of segment 21 and flexes it in a second sense, namely upwardly, at prescored line 18. These two successive flexings in two senses cause the metal to break at line 18 and the segment 21 is thus separated from the terminal at a point within sleeve 11. The assembled terminal and the separated segment may be removed from the apparatus by any convenient means, and the next terminal on the carrier strip is moved into the leading position.

What is claimed is:

1. Apparatus for separating an assembled insulated wire terminal from a carrier strip segment, the assembled terminal including a metal body having at its rear end wire receiving elements and at its forward end terminal receiving elements, and having an insulated plastic sleeve surrounding the metal body, the forward end being attached to the carrier strip segment at a separation line prescored on both surfaces of the metal and extending generally parallel to the length of the carrier strip and being within the sleeve, comprising positioning means to retain the assembled wire terminal in a fixed position, said positioning means comprising a base defining a feed path for the carrier strip with attached terminals, and retaining means fixed with respect to said base adjacent said base feed path and cooperating therewith to retain an insulated terminal in a fixed position, and flexing means to flex the carrier strip segment at the prescored separation line successively in two senses with respect to the wire terminal retained in said fixed position to separate the carrier strip segment from the terminal at the prescored separation line within the sleeve, said flexing means comprising a separating tool having a segment-flexing end adjacent said base providing spaced first and second segment-flexing surfaces extending generally parallel to said feed path, reciprocating means for reciprocating said separating tool with respect to said base feed path in engagement with the carrier strip, connecting means connecting said separating tool and said reciprocating means at a point spaced from said segment-flexing end for motion of said segment-flexing end away from said reciprocating means and generally transverse to said feed path, and biasing means for returning said segment-flexing end toward said reciprocating means, whereby, as said reciprocating means moves said separating tool toward said base feed path, said separating tool first segment-flexing surface engages the carrier strip segment to flex the segment in a first sense from the pre-scored line and to cam said segment-flexing end into motion away from said reciprocating means and past the segment, said biasing means tending to return said separating tool toward said reciprocating means, and, as said reciprocating means reverses to move said separating tool away from said base feed path, said separating tool second segment-flexing surface engages the segment to flex the segment in a second sense from the pre-scored line to separate the terminal from the segment.

2. Apparatus for separating an assembled insulated wire terminal from a carrier strip, the assembled terminal including a metal body having at its rear end wire receiving elements and at its forward end terminal receiving elements, and having an insulating plastic sleeve surrounding the metal body, a separation line extending generally parallel to the length of the carrier strip prescored on both surfaces of the metal and being within the plastic sleeve, comprising a base defining a feed path for the carrier strip with attached terminals and providing a base cutting edge generally transverse to and beneath said feed path, housing means fixed with respect to said base and including retaining means adjacent said base feed path and cooperating therewith to retain an insulated terminal in a fixed position, a separating tool having a segment-flexing end adjacent said base providing upper and lower segment-flexing surfaces extending generally parallel to said feed path and spaced apart vertically, said segment-flexing end further providing a cutting edge adjacent said base cutting edge and parallel thereto, reciprocating means for reciprocating said separating tool vertically past said base cutting edge, connecting means connecting said separating tool and said reciprocating means at a point spaced from said segment-flexing end for motion of said segment-flexing end away from said reciprocating means and generally transverse to said feed path, and biasing means for returning said separatin tool into perpendicular orientation with respect to said base, whereby, as said reciprocating means moves said separating tool downwardly, said separating tool cutting edge is carried downwardly past said base cutting edge to sever a leading strip segment with attached terminal from the carrier strip, and said separating tool lower segment-flexing surface engages the segment to flex the segment downwardly from the pre-scored line and to cam said segment-flexing end into motion away from said reciprocating means and past the segment, said biasing means tending to return said separating tool into perpendicular orientation, and, as said reciprocating means moves said separating tool upwardly, said separating tool upper segment-flexing surface engages the segment lower surface to flex the segment upwardly from the pre-scored line to separate the terminal from the segment.

* * * * *